US009179512B2

(12) United States Patent
Ni

(10) Patent No.: US 9,179,512 B2
(45) Date of Patent: Nov. 3, 2015

(54) MULTI-SEGMENT LED LIGHTING APPARATUS CONFIGURATIONS

(71) Applicant: Cree, Inc., Durham, NC (US)

(72) Inventor: Liqin Ni, Cary, NC (US)

(73) Assignee: Cree, Inc., Durham, NC (US)

( * ) Notice: Subject to any disclaimer, the term of this patent is extended or adjusted under 35 U.S.C. 154(b) by 429 days.

(21) Appl. No.: 13/672,315

(22) Filed: Nov. 8, 2012

(65) Prior Publication Data

US 2014/0125229 A1 May 8, 2014

(51) Int. Cl.
*H05B 41/00* (2006.01)
*H05B 33/08* (2006.01)

(52) U.S. Cl.
CPC ..... *H05B 33/083* (2013.01)

(58) Field of Classification Search
CPC ..... H05B 33/0851; H05B 33/0809; H05B 33/0815; H05B 33/0821; H05B 33/0827; H05B 33/083
See application file for complete search history.

(56) References Cited

U.S. PATENT DOCUMENTS

| | | | | |
|---|---|---|---|---|
| 7,688,002 | B2 | 3/2010 | Ashdown et al. | |
| 8,471,495 | B2 * | 6/2013 | Muguruma et al. | 315/299 |
| 8,519,631 | B2 * | 8/2013 | Lee et al. | 315/193 |
| 8,742,671 | B2 * | 6/2014 | van de Ven et al. | 315/127 |
| 8,917,025 | B2 * | 12/2014 | Park et al. | 315/188 |
| 2004/0189218 | A1 | 9/2004 | Leong et al. | |
| 2007/0013647 | A1 | 1/2007 | Lee et al. | |
| 2008/0122376 | A1 | 5/2008 | Lys | |
| 2009/0135592 | A1 | 5/2009 | Hamada | |
| 2010/0109557 | A1 | 5/2010 | Bouchard | |
| 2010/0295460 | A1 * | 11/2010 | Lin et al. | 315/193 |
| 2010/0327765 | A1 | 12/2010 | Melanson et al. | |
| 2011/0101883 | A1 | 5/2011 | Grajcar | |
| 2011/0199003 | A1 * | 8/2011 | Muguruma et al. | 315/122 |

* cited by examiner

*Primary Examiner* — Douglas W Owens
*Assistant Examiner* — Monica C King
(74) *Attorney, Agent, or Firm* — Myers Bigel Sibley & Sajovec, P.A.

(57) ABSTRACT

A solid state lighting apparatus can include a Light Emitting Diode (LED) string that includes a plurality of light emitting diode (LED) segments that are coupled in series with one another wherein a ratio of respective numbers of LEDs in each of the segments is about equal to a ratio of respective average powers for each of the respective segments. Other configurations are also disclosed.

22 Claims, 6 Drawing Sheets

| TEST ITEM | PIN (W) | OUTPUT LUMENS (LUM) | EFFICACY (LPW) |
|---|---|---|---|
| UNIT 2 | 10.57 | 858 | 81.2 |
| UNIT 1 | 10.79 | 928 | 86 |

MULTI-SEGMENT LED LIGHTING APPARATUS CONFIGURATIONS

FIELD

The present inventive subject matter relates to lighting apparatus and methods and, more particularly, to LED lighting apparatus.

BACKGROUND

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs), which may include inorganic LEDs, which may include semiconductor layers forming p-n junctions, and/or organic LEDs (OLEDs), which may include organic light emission layers.

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e., electrons and holes, in a light emitting layer or region.

Solid state lighting panels are commonly used as backlights for small liquid crystal display (LCD) screens, such as LCD display screens used in portable electronic devices. In addition, there has been increased interest in the use of solid state lighting panels as backlights for larger displays, such as LCD television displays.

SUMMARY

Embodiments according to the invention can provide multi-segment LED lighting apparatus configurations. Pursuant to these embodiments, a solid state lighting apparatus can include a Light Emitting Diode (LED) string that includes a plurality of light emitting diode (LED) segments coupled in series with one another wherein a ratio of respective lumen output from each of the segments is about equal to a ratio of respective average powers for each of the respective segments.

In some embodiments according to the invention, the respective lumen output from each of the segments is provided by a respective total epi-area for each of the segments. In some embodiments according to the invention, a ratio of respective numbers of LEDs in each of the segments is about equal to the ratio of the respective average powers for each of the respective segments. In some embodiments according to the invention, the LEDs included in each of the segments are identical.

In some embodiments according to the invention, the respective number of LEDs in each of the segments are coupled together in parallel where the respective number is greater than 1. In some embodiments according to the invention, a first-on/last-off segment included in the plurality of segments includes LEDs having highest efficacy of all LEDs in the string.

In some embodiments according to the invention, a last-on/first-off segment included in the plurality of segments can include LEDs having lowest efficacy of all LEDs in the string. In some embodiments according to the invention, a first-on/last-off segment included in the plurality of segments can include LEDs having highest efficacy of all LEDs in the string and a last-on/first-off segment included in the plurality of segments includes LEDs having lowest efficacy of all LEDs in the string.

In some embodiments according to the invention, the string can include 3 segments having equal forward voltages and a ratio of currents for respective utilizations of the segments of 1:2:3, where a ratio of respective efficacies of LEDs in each of the segments is 3 for a first-on/last-off segment, 2 for an intermediate segment, and 1 for a last-on/first-off segment. In some embodiments according to the invention, the string can include 3 segments wherein the ratio of respective average powers in each of the segments is 17 for a first-on/last-off segment, 15 for an intermediate segment, and 9 for a last-on/first-off segment.

In some embodiments according to the invention, the ratio of respective numbers of LEDs in each of the segments can be 3 in a first-on/last-off segment, 2 in an intermediate segment, and 1 for a last-on/first-off segment. In some embodiments according to the invention, the apparatus can further include a rectifier circuit housed in the solid state lighting apparatus, coupled to an ac voltage source configured to provide a rectified ac voltage and a driver circuit, coupled to the rectifier circuit and configured to provide current to the string.

In some embodiments according to the invention, the driver circuit can further include a plurality of current diversion circuits, respective ones of which are coupled in parallel with respective segments and configured to operate responsive to bias state transitions of the respective segments.

In some embodiments according to the invention, a solid state lighting apparatus can include a Light Emitting Diode (LED) string including a plurality of light emitting diode (LED) segments coupled in series with one another, wherein a first-on/last-off segment included in the plurality of segments includes LEDs having highest efficacy of all LEDs in the string and a last-on/first-off segment included in the plurality of segments includes LEDs having lowest efficacy of all LEDs in the string.

In some embodiments according to the invention, a solid state lighting apparatus can include a Light Emitting Diode (LED) string including a plurality of light emitting diode (LED) segments coupled in series with one another, wherein a ratio of respective numbers of LEDs in each of the segments is about equal to a ratio of respective average powers for each of the respective segments and a first-on/last-off segment included in the plurality of segments includes highest efficacy LEDs in the string and a last-on/first-off segment included in the plurality of segments includes lowest efficacy LEDs in the string.

In some embodiments according to the invention, a solid state lighting apparatus can include a Light Emitting Diode (LED) string including a plurality of light emitting diode (LED) segments coupled in series with one another, wherein an earlier utilized segment included in the plurality of segments includes LEDs having greater efficacy than LEDs included in a later utilized segment included in the plurality of segments.

In some embodiments according to the invention, a solid state lighting apparatus can include a Light Emitting Diode (LED) string including a plurality of light emitting diode (LED) segments coupled in series with one another, wherein a total epi-area included in an earlier utilized segment included in the plurality of segments is greater than a total epi-area included in a later utilized segment included in the plurality of segments.

DETAILED DESCRIPTION OF EMBODIMENTS ACCORDING TO THE INVENTION

Figure 1:
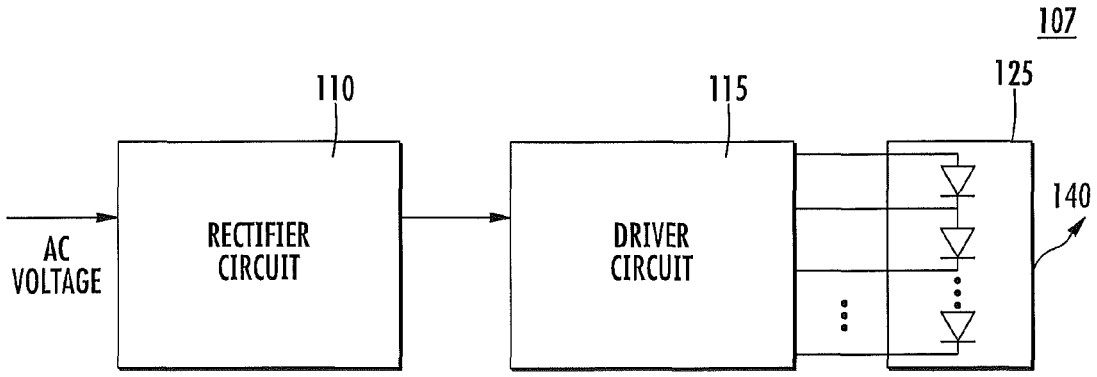
FIG. 1 is a block diagram of an LED lighting apparatus including a rectifier circuit coupled to a driver circuit, which operates a multi-segment LED string.

Embodiments of the present inventive subject matter now will be described more fully hereinafter with reference to the accompanying drawings, in which embodiments of the present inventive subject matter are shown. This present inventive subject matter may, however, be embodied in many different forms and should not be construed as limited to the embodiments set forth herein. Rather, these embodiments are provided so that this disclosure will be thorough and complete, and will fully convey the scope of the present inventive subject matter to those skilled in the art. Like numbers refer to like elements throughout.

The expression "lighting apparatus", as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing ac incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

As appreciated by the present inventor, certain configurations of LED strings can provide improved efficacy and balanced power dissipation, as well as, reduce perceived flicker. For example, in some embodiments according to the invention, efficacy and balanced power dissipation in a lighting apparatus may be improved by particular configurations of LEDs within segments in the string. As appreciated by the present inventor, for example, segments of the LED string can include particular numbers of LEDs arranged in parallel. For example, in some embodiments according to the invention, a ratio of respective numbers of LEDs in each of the segments can be made about equal to a ratio of respective average powers for each of the respective segments to improve efficacy and balanced power dissipation of the LED apparatus.

In still other embodiments according to the invention, perceptible flicker may be reduced by including LEDs having a particular efficacy in particular segments of the string. For example, as appreciated by the present inventor, perceptible flicker may be reduced when the highest efficacy LEDs in the string are placed in one of the segments of the string, whereas the LEDs having the lowest efficacy of those in the string are placed in another segment of the string. For example, in some embodiments according to the invention, the highest efficacy LEDs are included in the first on/last off segment of the string, whereas the lowest efficacy LEDs can be included in the last on/first off segment of the string to reduce perceived flicker. In some embodiments according to the invention, a combination of features may be provided to allow the improvements described herein.

FIG. 1 is a block diagram of an LED lighting apparatus 100 that includes a rectifier circuit 110 coupled to a driver circuit 115, which operates a multi-segment LED string 125. According to FIG. 1, the multi-segment LED string 125 can include a plurality of LED segments, which are coupled in series to provide an LED string controlled by the driver circuit 115 via pairs of terminals coupled across respective ones of the LED segments.

It will be understood that the term LED "segment" refers to a separately biased portion of an LED string. A segment can include at least one LED device, which can itself include a number of serially connected epi junctions used to provide a device that has a particular forward voltage, such as 3V, 6V, 9V, etc. where a single epi junction may have a forward voltage of about 1.5 volts. Each segment may include multiple LEDs that are connected in various parallel and/or serial arrangements. The segments LEDs may be configured in a number of different ways and may have various compensation circuits associated therewith, as discussed, for example, in commonly assigned co-pending U.S. application Ser. No. 13/235,103 . U.S. application Ser. No. 13/235,127.

In operation, the rectifier circuit 110 provides a rectified ac voltage to the driver circuit 115 based on an ac voltage. The driver circuit 115 can separately bias the LED segments using the respective pairs of terminals that are coupled across the segments, to emit light 140. For example, as the level of the rectified ac voltage begins to increase, the driver circuit 115 can forward bias a first LED segment of the multi-segment LED string 125 by providing a forward bias voltage across the first pair of terminals, whereas the remainder of the LED segments in the LED string remain off. As the rectified ac voltage level continues to increase, the driver circuit 115 can separately forward bias the remaining LED segments until each of the LED segments in the multi-segment LED string 125 is progressively enabled to emit the light 140. This process is reversed as the level of the rectified ac voltage is reduced during the latter half of the rectified ac voltage cycle, so that the segments are progressively turned off. Accordingly, the light 140 may increase in intensity as more of the segments are enabled and decrease in intensity as the more of the segments are disabled.

Figure 2:
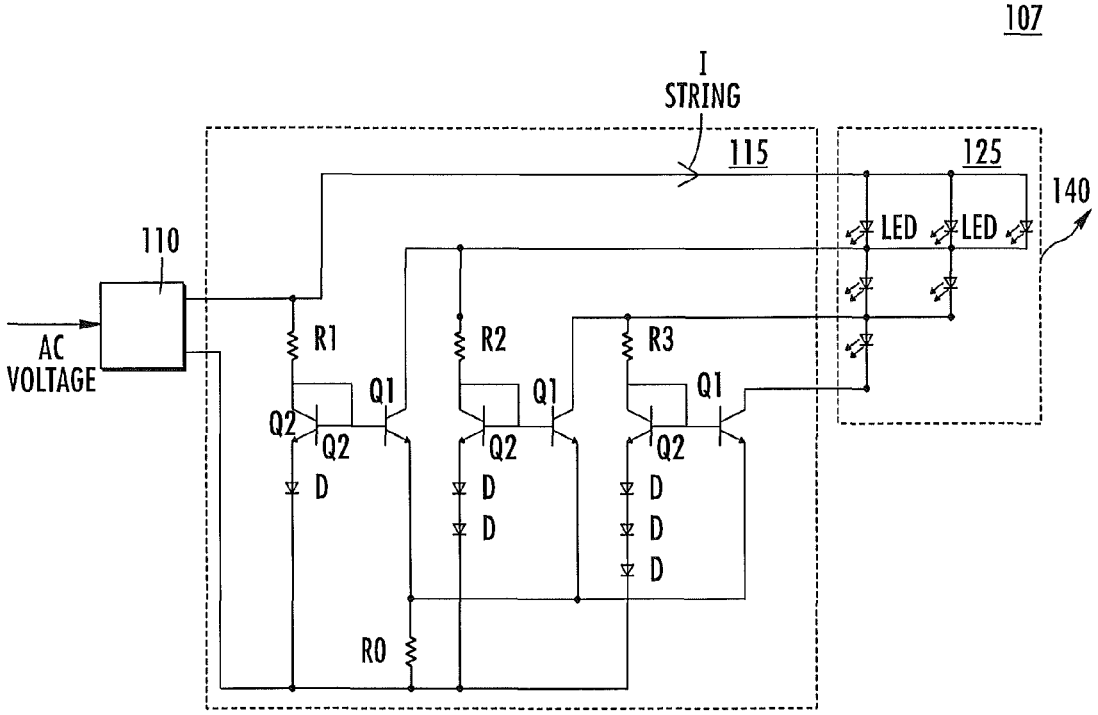
FIG. 2 is a circuit schematic diagram illustrating the LED driver circuit coupled to the LED string in some embodiments according to the invention.
Figure 3:
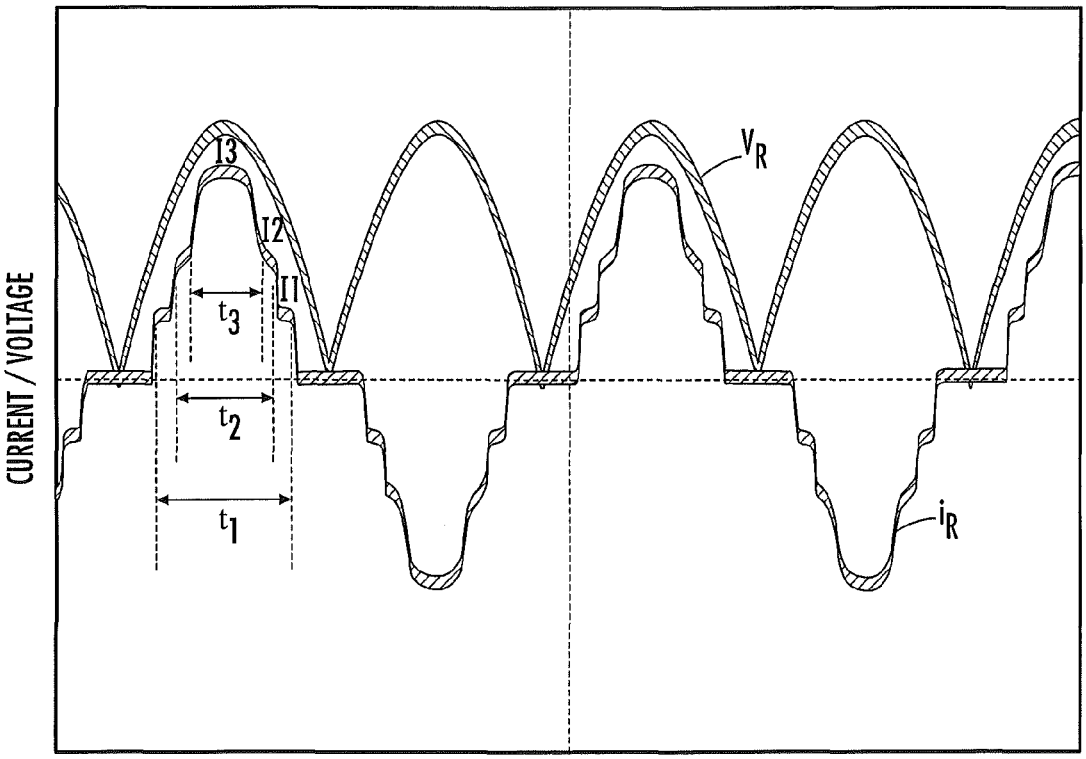
FIG. 3 is graph illustrating LED string current and voltage waveforms associated with the LED string responsive to the driver circuit in some embodiments according to the invention.

FIG. 2 is a circuit schematic diagram illustrating the driver circuit 115 and coupled to the LED string 125 in some embodiments according to the invention. FIG. 3 is graph illustrating current and voltage waveforms associated with the particular configuration of the LED string 125 responsive to the driver circuit 115.

According to FIG. 2, the LED string 125 includes three segments coupled in series with one another, where each of the segments includes a different number of LEDs coupled in parallel with one another. In particular, the LED string includes a first-on/last-off segment that includes 3 LEDs coupled in parallel with one another, an intermediate segment that includes 2 LEDs coupled in parallel, and a last-on/first-off segment including a single LED.

The segments can be separately biased by the driver circuit 115, so that for example, the first segment can be forward biased once the rectified ac voltage reaches a first particular level, then the first and second segments can both be forward biased once the rectified ac voltage reaches a second particular level, and then the first, second and third segments can all be forward biased when the rectified ac voltage reaches a third particular level, whereupon all segments in the LED string 125 emit the first light 140. This sequence of biasing is reversed when the phase of the rectified ac voltage passes 90 degrees, whereupon the first LED segment turns off when the first particular level is passed.

Accordingly, the first segment including three LEDs in parallel is referred to as the "first on/last off" segment, the middle segment including two LEDs in parallel is referred to as the "intermediate segment," and the third segment including a single LED is referred to as the "last on/first off" segment. It will be understood that LED strings 125 according to the present invention can include any total number of LEDs arranged into a particular configuration as described herein. For example, the LED string 125 may include 6, 12, 24, etc. total LEDs. Other total numbers of LEDs can also be used.

In some embodiments according to the invention, the different segments are referred to by the time in which the respected segment turns on during a cycle of the rectified AC voltage. For example, in some embodiments according to the invention, an LED segment which is turned on relatively early in the cycle is referred to as an earlier utilized segment, whereas a later activated LED segment can be referred to as a later utilized segment in that the later utilized segment is enabled after the earlier utilized segment. In some embodiments according to the invention, the term "utilized" refers to the determinations of utilization described herein in reference to, for example, FIG. 2. In still further embodiments according to the invention, further LED segments in the LED string can be referred to as intermediate utilized segments which are activated after the earlier utilized segments but before the later utilized segments.

Accordingly, even though an LED string may include a number of LED segments, only a subset of the LED segments may be referred to as earlier, intermediate, and later utilized segments. For example, an LED string, in some embodiments according to the invention, may include six different segments whereas a subset of these six LED segments are referred to as an earlier utilized segment, an intermediate utilized segment, and a later utilized segment. In other words, in some embodiments according to the invention, the utilization used to refer to a certain segment can describe its relative utilization within a greater number of segments in the string. For example, in some embodiments according to the invention including six LED segments, a second segment can be referred to as the earlier utilized segment, the fourth segment can be an intermediate utilized segment, and the fifth segment can be the later utilized segment.

As further shown in FIG. 2, the driver circuit 115 includes respective current diversion circuits that are connected to respective segments of the LED string 125. The current diversion circuits are configured to provide current paths that bypass the respective segment responsive to the level of the rectified ac voltage. The current diversion circuits each include a transistor Q1 that is configured to provide a controlled current path that may be used to selectively bypass the respective segment to which it is connected. The transistors Q1 are biased using transistors Q2, resistors R1, R2, and R3 and diodes D. The transistors Q2 are configured to operate as diodes, with their base and collector terminals connected to one another. Differing numbers of diodes D are connected in series with the transistors Q2 in respective ones of the current diversion circuits, such that the base terminals of current path transistors Q1 in the respective current diversion circuits are biased at different voltage levels. Resistors R1, R2, and R3 serve to limit base currents for the current path transistors Q1.

The current path transistors Q1 of the respective current diversion circuits will turn off at different emitter bias voltages, which are determined by a current flowing through a resistor R0. Accordingly, the current diversion circuits are configured to operate in response to bias state transitions of the different segments as the rectified ac voltage increases and decreases such that the segments are progressively activated and deactivated as the rectified ac voltage rises and falls. The current path transistors Q1 are turned on and off as bias states of the segments change.

The LED string 125 may also be coupled in series with a current limiter circuit, such as a current mirror circuit, although any type of current limiter circuit may be used in embodiments according to the invention. One or more storage capacitors may be coupled in parallel with the LED string 125 and the current mirror circuit. The current mirror circuit may be configured to limit current through the LED string 125 to an amount that is less than a nominal current provided to the LED string 125. This type of configuration is described further in, for example, U.S. application Ser. No. 13/235,103, and in U.S. application Ser. No. 13/360,145, the contents of all of which are incorporated herein by reference.

The circuit of FIG. 2 can operate to provide color temperature control and compensation for the lighting apparatus 107, which are described in, for example, commonly assigned U.S. patent application Ser. No. 13/416,613, entitled METHODS AND CIRCUITS FOR CONTROLLING LIGHTING CHARACTERISTICS OF SOLID STATE LIGHTING DEVICES AND LIGHTING APPARATUS INCORPORATING SUCH METHODS AND/OR CIRCUITS, filed in the U.S.P.T.O. on Mar. 9, 2012, the entire contents of which are incorporated herein by reference. LED lighting systems to obtain a desired color point are described in U.S. Publication No. 2007/0115662 and 2007/0115228, the disclosures of which are incorporated herein by reference.

FIG. 3 is a graph illustrating current and voltage waveforms associated with operation of the LED string 125, responsive to the driver circuit 115 in some embodiments according to the invention. According to FIG. 3, a current waveform is depicted illustrating a current (I string) provided by the driver circuit 115 to the LED string 125 over cycles of the rectified AC voltage. In particular, during the first portion of the cycle, the rectified AC voltage is increased to the first particular level, whereupon the driver circuit 115 forward biases the first on/last off segment, including the three LEDs connected in parallel.

At this point, the string current is provided at a level I1, so that a first light is emitted by the LED string 125. When the level of the rectified AC voltage increases to the second particular level, the driver circuit 115 forward biases the both the first on/last off segment and the intermediate segment including the two LEDs coupled in parallel with one another. At this time, the string current is increased to I2. Subsequently, when the rectified AC voltage reaches the third particular level, the driver circuit 115 forward biases the first on/last off segment, the intermediate segment, as well as the last on/first off segment including a single LED. At this point, the string current increases to I3.

Figure 4:
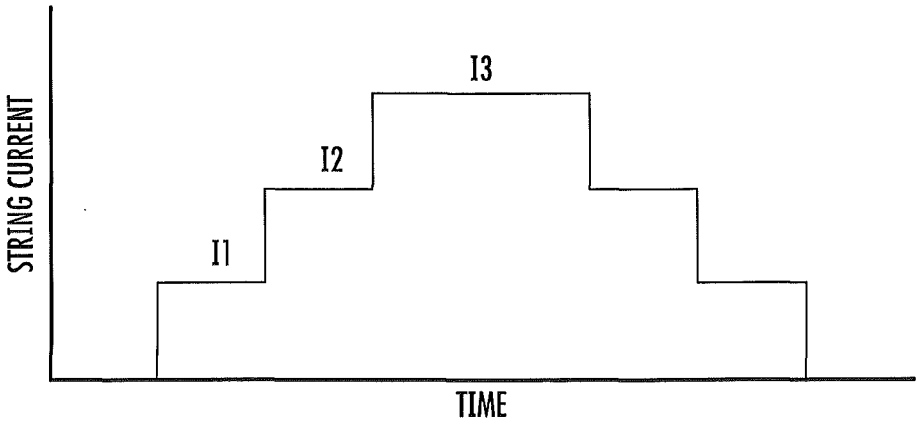
FIG. 4 is a graph illustrating idealized LED string current provided by the driver circuit over a cycle of the rectified ac voltage in some embodiments according to the invention.

During the latter half of the rectified AC voltage cycle, the driver circuit 115 disables the last on/first off segment, the intermediate segment, and finally, the first on/last off segment when the level of the rectified AC voltage passes the third particular level, the second particular level and finally, the first particular level, respectively. Accordingly, at the end of the rectified AC voltage cycle, the first on/last off segment has been enabled for a time t1 whereas the intermediate segment has been enabled for a second time t2 and finally, the last on/first off segment has been enabled for a time t3. FIG. 4 separately illustrates the current levels provided to the LED string 125 during the different utilizations of the segments over a single cycle of the rectified ac voltage.

In view of the above, the utilization (on-time) of each of the segments described above and shown in FIG. 2 can be expressed as follows:

First on/last off segment LEDs utilization is $$U1 = 1 - \frac{2 * \sin^{-1}\left(\frac{Vs1}{Vpk}\right)}{\pi};$$

Intermediate segment LEDs utilization is $$U2 = 1 - \frac{2 * \sin^{-1}\left(\frac{Vs1 + Vs2}{Vpk}\right)}{\pi};$$

Last on/first off segment LEDs Utilization is $$U3 = 1 - \frac{2 * \sin^{-1}\left(\frac{Vs1 + Vs2 + Vs3}{Vpk}\right)}{\pi},$$

where, Vs1, Vs2 and Vs3 are the forward voltages used to bias each of the first on/last off, intermediate, and last on/first off segments, respectively, provided by the driver circuit 115 and Vpk is the peak amplitude of the AC voltage.

As an example, if the forward voltages Vs1, Vs2 and Vs3 are all equal to 50 volts, the line voltage is 120 volts AC, the currents I1-I3 provided during the different utilizations are in a ratio (11:12:13) of 1:2:3, then the utilization of the first on/last off segment is about 81%, the utilization of the intermediate segment is about 60% and utilization of the last on/first off segment is about 31%. In other words, the above expressions provide that the first on/last off segment is on for about 81% of the cycle, the intermediate segment is on for about 60% of the cycle, and the last on/first off segment is on for about 31% of the cycle. It will be understood, however, that the utilizations will vary based on the values of Vs1, Vs2 and Vs3 (whether equal or not) and the peak line voltage.

The above utilizations for each of the segments can be used to determine the average power ratio for each of the segments in the LED string 125. In particular, the average power ratio can be estimated by considering both the utilizations and the string currents provided for the particular utilizations for each of the segments. For example, the average power ratio in each cycle for each of the segments in the LED string 125 of FIG. 2, can be estimated as:

$$P1:P2:P3=(U1+U2+U3):(2U2+U3):3U3=17:15:9,$$

P1 is the power ratio for the first on/last off segment, P2 is the power ratio for the for the intermediate segment, and P3 is the power ratio for the last on/first off segment.

The above average power ratios and utilizations can, in turn, be used to estimate the particular configurations of the segments in the LED string 125 shown in FIG. 2. In particular, as appreciated by the present inventor, if the ratio of LEDs included in each of the segments can be provided to closely match the average power ratio, the system efficacy and power dissipation may both be improved. Accordingly, when a particular number of LEDs is to be deployed as part of a lighting apparatus, the above relationships can provide a guide for the particular configuration of the number of LEDs to be used in each of the segments based on the average power ratios of those segments. For example, if a total number of 6 LEDs are to be deployed within the LED string, the average power ratio of 17:15:9 can be reduced to about 3:2:1, which provides that a configuration of 3 LEDs in parallel in the first on/last off segment, 2 LEDs in parallel in the intermediate segment, and 1 LED in the last on/first off segment, can improve system efficacy and power dissipation.

Although the description above refers to the configuration of LED segments by the number of LEDs coupled in parallel with one another in each of those segments, in some embodiments according to the invention, the total lumen output of each of the segments can also be provided by the respective average power ratios for each of the segments in the LED string 125. For example, in some embodiments according to the invention, the total lumen output for each of the segments in an LED string can be provided using the equations described above to determine the average power ratio for each of the segments during a cycle so that rather focusing on the number of LEDs provided in parallel in each of the segments, the teachings herein can be utilized to provide a total lumen output in each of the segments in accordance with the average power ratio described above.

In still further embodiments according to the invention, the number of LEDs coupled in parallel with one another and/or the total lumen output in each of the segments can be alternatively expressed by the total epi area for each of the segments in the LED string. For example, in some embodiments according to the invention, the relationship between the average power ratios for each of the segments can be used to determine the ratio of total epi area used for each of the segments. Accordingly, the ratios described above with reference to the number of LEDs to be used in each of the segments, can be modified (i.e., either increased or decreased) by instead focusing on the epi area provided in each of the segments. For example, in some embodiments according to the invention, what would in one embodiment be provided by three LEDs coupled in parallel with one another, may be provided by a single LED having the same total epi area as those three LEDs coupled in parallel with one another. In still further embodiments according to the invention, the epi area may be determined by the number of epi junctions that are coupled in series with one another in a particular LED or in a segment.

Figures 7, 8:
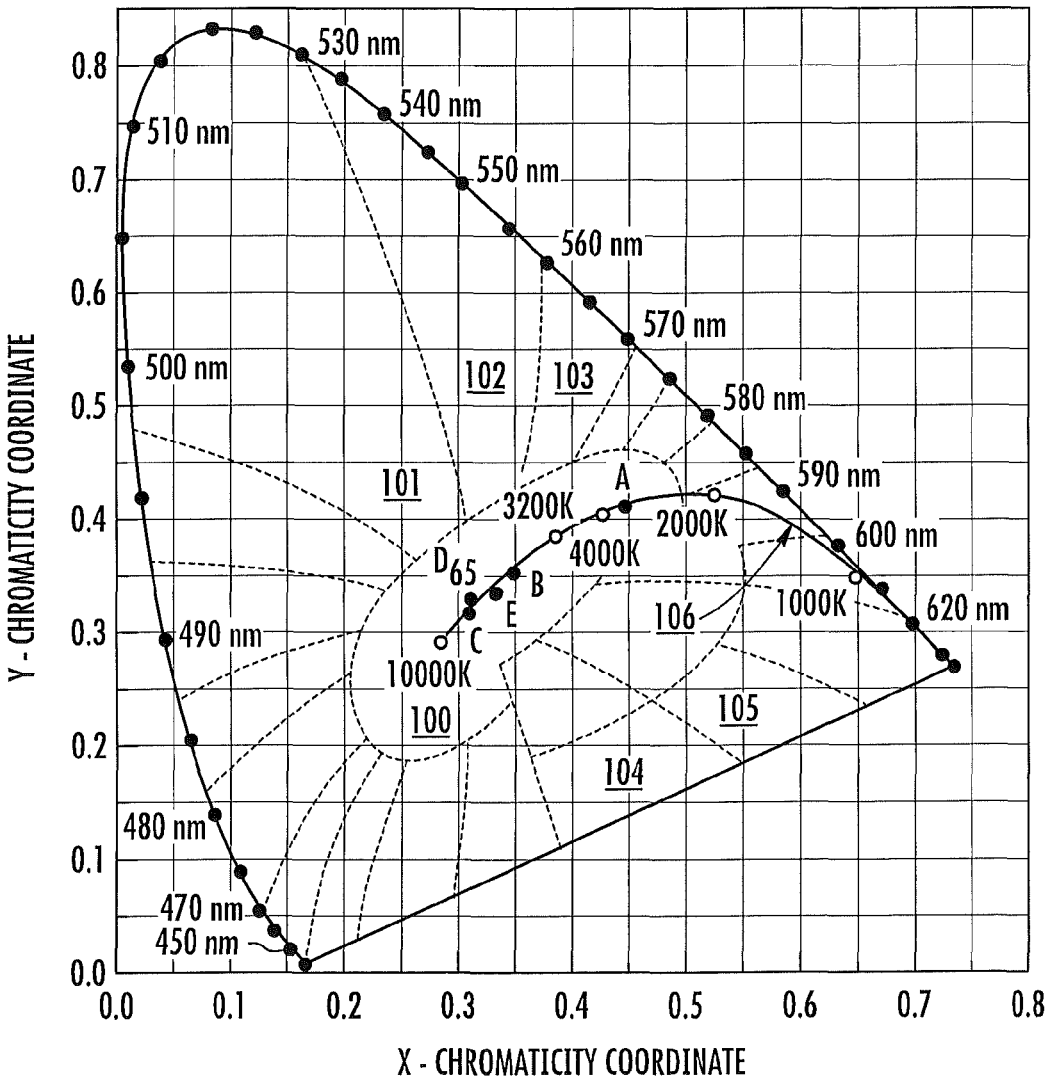
FIG. 7 is a table of results associated with an embodiment according to the invention.
FIG. 8 is a 1931 CIE chromaticity diagram.

In experiments conducted in accordance with an embodiment of the invention shown herein, the configuration of LEDs shown in FIG. 2 were tested relative to a conventional arrangement employing 2 LEDs in parallel in the first on/last off segment, 2 LEDs in parallel in the intermediate segment and 2 LEDs in parallel in the last on/first off segment. In summary, the Table 1 shown in FIG. 7 illustrates that an embodiment according to the present invention as illustrated in FIG. 2 (Unit 1) having a configuration of 3 LEDs in parallel in the first on/last off segment, 2 LEDs in parallel in the intermediate segment, and 1 LED in the last on/first off segment, exhibited almost 5 lumens per watt greater efficiency compared to the conventional system (Unit 2) described above. This is evidenced by Table 1 showing that approximately the same power was provided to both Units 1 and 2, whereas the lumens output from Unit 1, according to the presention invention, produced about 928 lumens whereas Unit 2 produced about 858 lumens. As appreciated by the present inventor, particular configurations of the segments included in the LED string can be provided based on a ratio of the respective average powers for each of the segments to be included in the LED string.

It will also be understood that although the embodiments described above relate to LED strings including 3 segments, the same approach may be readily applied to LED strings including more segments. For example, in some embodiments according to the invention, the same approach to determining the utilization, the average power ratios, and finally, the particular configurations of parallel arrangements of LEDs within the segments, can be utilized for an arbitrary number of segments to be included in the LED string.

For example, in some embodiments according to the invention, the terminology described above in reference to the utilization of certain segments can be used in conjunction with the number of parallel LEDs included in the respective segments. For example, in some embodiments according to the invention as described herein, certain numbers of LEDs coupled in parallel with one another, can be included in the earlier, intermediate, and later utilized segments in accordance with the teachings herein regarding the number of LEDs which can be implemented in each of the LED segments. For example, in some embodiments according to the invention, the number of LEDs coupled in parallel with one another within a subset of segments in a LED string including a greater number of segments can be provided by the equations described above included in the different utilization segments.

As further appreciated by the present inventor, perceived flicker may also be addressed by particular configurations of LEDs within the string 125 shown in FIG. 2. For example, perceptible flicker may be reduced by including the highest efficacy LEDs in a string in the first on/last off segment, whereas the lowest efficacy LEDs in the string can be included in the last on/first off segment.

Figure 5:
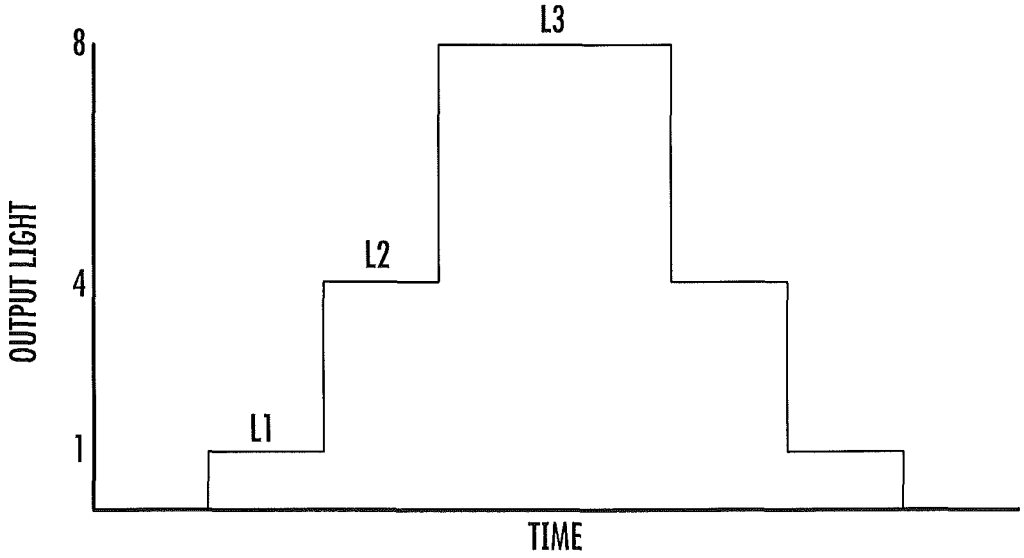
FIG. 5 is a graph illustrating LED string lumen output over a cycle of the rectified ac voltage.

This can be illustrated using an approach similar to that described above. For example, in a 3 segment system as illustrated in FIG. 2, and assuming: the forward voltages of each of the segments is about the same (Vs1, Vs2 and Vs3), the current ratio I1:I2:I3 is about equal to 1:2:3 as depicted in FIG. 3 and in FIG. 4, and the efficacy is assumed to be the same for each of the LEDs used to implement the LED string 125, then the ratio for the light output (in lumens) for each of the segments in the LED string 125 can be expressed as:

$$(Vs1*I1*E):(Vs1*I2*E+Vs2*I2*E):(Vs1*I3*E+Vs2*I3*E+Vs3*I3*E)=1:4:9,$$

which is depicted graphically in FIG. 5 which shows the lumen output for each of the segments for the configuration shown in FIG. 2.

Figure 6:
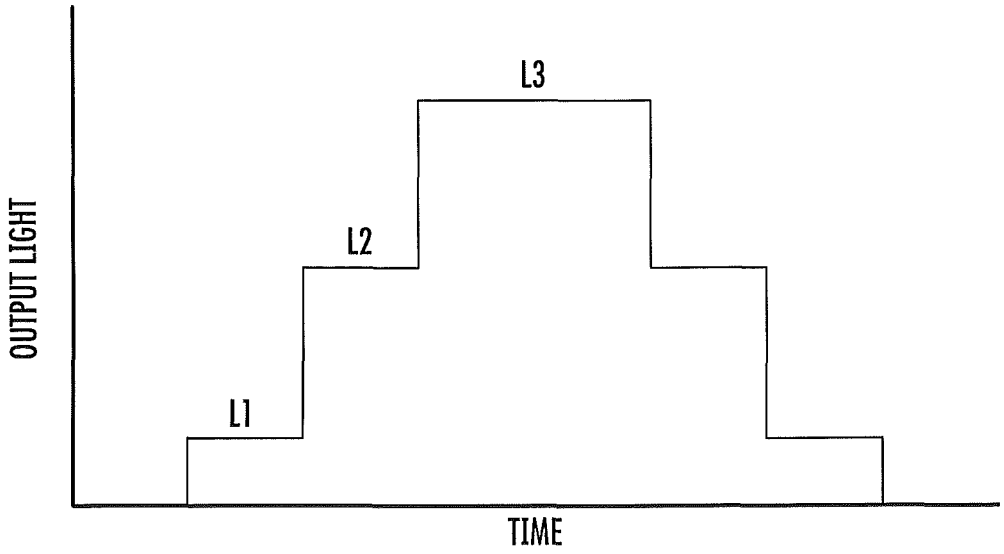
FIG. 6 is a graph illustrating LED string lumen output over a cycle of the rectified ac voltage in some embodiments according to the invention.

If, however, the efficacy described above for each of the LEDs used in the different segments is assumed to be different, then light output for each of the segments may be modified to reduce the depth of modulation as shown, for example in FIG. 6. In particular, if an efficacy ratio for each of the segments (E1:E2:E3) is set to be 3:2:1, a ratio of the output light in lumens (L1, L2, L3) can be expressed as:

$$(Vs1*I1*E1):(Vs1*I2*E1+Vs2*I2*E2):(Vs1*I3*E1+Vs2*I3*E2+Vs3*I3*E3)=3:10:18,$$

which is depicted graphically in FIG. 6. In comparing FIGS. 5 and 6, it will be seen that the steps in output light in FIG. 6 are reduced relative to that shown in FIG. 5. Therefore, in some embodiments according to the invention, setting the ratio of efficacies for the different segments to be analogous to those ratios described above in reference to efficacy in power dissipation can also reduce perceptible flicker. In particular, if the ratio of output light in lumens of 3:10:18 is reduced to its lowest form, the same ratio can be expressed as approximately 1:3:6 which is illustrated in FIG. 6. Accordingly, as illustrated by the efficacy ratio for each of the segments described above (i.e., 3:2:1), it will be understood that including the highest efficacy LEDs in the first on/last off segment, whereas the lowest efficacy LEDs may be included in the last on/first off segment to address perceptible flicker.

In some embodiments according to the invention, it will be understood that an LED string including any number of segments may be implemented in accordance with the approach described herein. For example, similar to that described above in reference to increased numbers of segments in the LED string, the same determination is described above in reference to flicker can also be made in reference to LED strings including more than three segments. Still further, implementations may be also be provided wherein different forward voltages are provided in the string rather than equal forward voltages as described above.

It will be understood that any particular efficacy LEDs may be used in accordance with embodiments described herein, where those LEDs are arranged in parallel configurations as described herein. For example, in some embodiments according to the invention, LEDs such as Cree XLamp XT-E White LEDs may be utilized as the highest efficacy LEDs in the string. LEDs such as Cree XP-E High Efficiency White LEDs may be utilized as the lowest efficacy LEDs in the string. In addition to light output and efficacy, XP-E HEW LEDs can also provide reduced thermal resistance of 6° C./W. XP-E High, both of which are available from Cree, Inc. as listed on the internet at: http://www.cree.com/led-components-and-modules/products, the entirety of which is incorporated herein by reference. Other LEDs can also be used.

In still further embodiments according to the invention, rather than address perceived flicker by configuring the string so that the first on/last off and last on/first off segments includes certain relative efficacy of LEDs, the configuration of the particular LED segments can be so that earlier utilized segments of the LED string include higher efficacy LEDs than later utilized segments. For example, in some embodiments according to the invention, an LED string including six segments in series with one another can be configured so that the higher efficacy LEDs are included in the second LED segment, whereas lower efficacy LEDs (i.e., LEDs having efficacy that is lower than those included in the second segment) can be included in the fifth LED segment. In still further embodiments according to the invention, an intermediate utilized string can be configured to include LEDs that have efficacy that is both less than the efficacy of the LEDs included in the second string but greater than the efficacy of the LEDs included in the sixth string.

Figure 9:
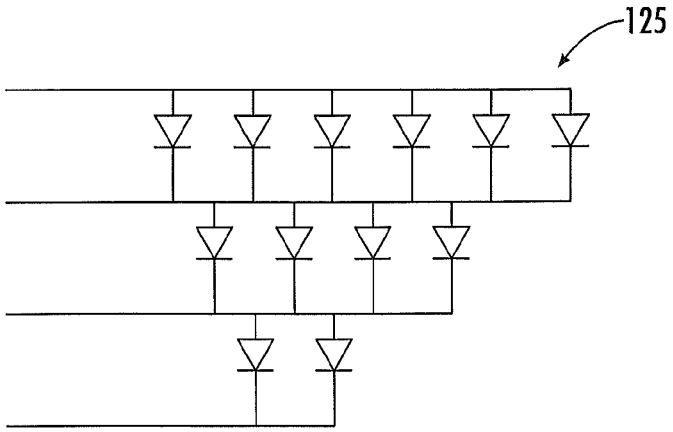
FIG. 9 is a particular configuration of the LED string in some embodiments according to the invention.

In still other embodiments according to the invention, particular configurations of LEDs can be provided for the LED string, as shown for example, in FIG. 9. According to FIG. 9, a three segment LED string can be provided as an implementation of the 3:2:1 ratio of the number of LEDs coupled in parallel in each of the segments. In particular, the LED string shown can include 6 LEDs in parallel in the first on/last off segment, 4 LEDs in parallel in the intermediate segment, and 2 LEDs in parallel in the last on/first off segment. The types of LEDs used in the particular segments can be as described above in reference to FIG. 2, however, other types of LEDs can also be used. The forward voltages of the segments can each be, for example, 50 Volts.

Figure 10:
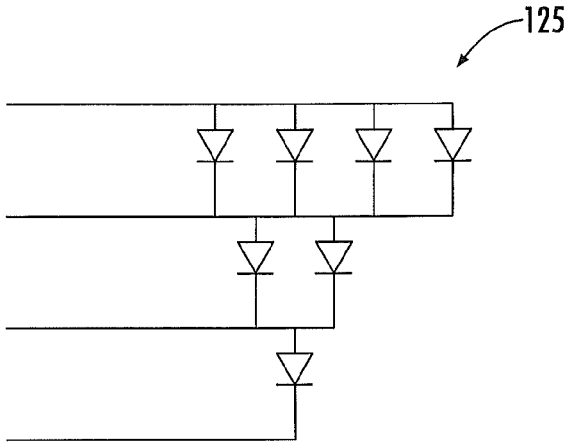
FIG. 10 is a particular configuration of the LED string in some embodiments according to the invention.

In still other embodiments according to the invention, particular configurations of LEDs can be provided for the LED string, as shown for example, in FIG. 10. According to FIG. 10, a four segment LED string can be provided as a close approximation of the 3:2:1 ratio of the number of LEDs coupled in parallel in each of the segments. In particular, the LED string shown can include 4 LEDs in parallel in the first on/last off segment, 2 LEDs in parallel in the intermediate segment, and 1 LED in the last on/first off segment. The types of LEDs used in the particular segments can be as described above in reference to FIG. 2, however, other types of LEDs can also be used.

Figure 11:
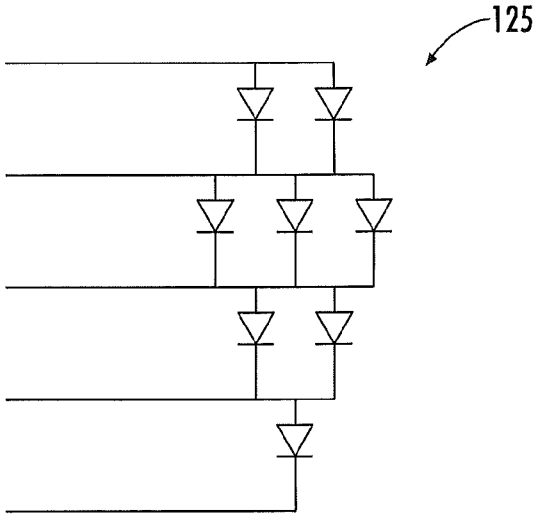
FIG. 11 is a particular configuration of the LED string in some embodiments according to the invention.

In other embodiments according to the invention, particular configurations of LEDs can be provided for the LED string, as shown for example, in FIG. 11. According to FIG. 11, a four segment LED string can be provided with LEDs coupled in parallel in 3 of the segments. In particular, the LED string shown can include 2 LEDs in parallel in the first on/last off segment, 3 LEDs in parallel in the first intermediate segment, 2 LEDs in parallel in the second intermediate segment, and 1 LED in the last on/first off segment. The types of LEDs used in the particular segments can be as described above in reference to FIG. 2, however, other types of LEDs can also be used. The forward voltages of the segments can each be equal, for example, 50 Volts. In some embodiments according to the invention, the forward voltages of the segments can be different, such as 25V, 50V, 50V, and 25V respectively.

It will be further understood that the LED string 125 can include LEDs of varying colors to provide lighting products having a relatively high color rendering index (CRI). One approach to providing high CRI lighting is to use "white LED lights" (i.e., lights which are perceived as being white or near-white). The use of these types (and other) LEDs can promote truer color reproduction, which is typically measured using the Color Rendering Index (CRI). CRI is a relative measurement of how the color rendition of an illumination system compares to that of a blackbody radiator, i.e., it is a relative measure of the shift in surface color of an object when lit by a particular lamp. The CRI equals 100 if the color coordinates of a set of test colors being illuminated by the illumination system are the same as the coordinates of the same test colors being irradiated by the blackbody radiator. Daylight has the highest CRI (of 100), with incandescent bulbs being relatively close (about 95), and fluorescent lighting being less accurate (70-85). Certain types of specialized lighting have relatively low CRI's (e.g., mercury vapor or sodium, both as low as about 40 or even lower). Sodium lights are used, e.g., to light highways. Driver response time, however, significantly decreases with lower CRI values (for any given brightness, legibility decreases with lower CRI).

A representative example of a white LED lamp includes a package of a blue light emitting diode chip, made of gallium nitride (GaN), coated with a phosphor such as YAG. In such an LED lamp, the blue light emitting diode chip produces a blue emission and the phosphor produces yellow fluorescence on receiving that emission, which is sometimes referred to as blue shifted yellow (BSY). For instance, in some designs, white light emitting diodes are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light.

More specifically, a "BSY LED" refers to a blue LED and an associated recipient luminophoric medium that together emit light having a color point that falls within a trapezoidal "BSY region" on the 1931 CIE Chromaticity Diagram of FIG. 8 defined by the following x, y chromaticity coordinates: (0.32, 0.40), (0.36, 0.48), (0.43, 0.45), (0.42, 0.42), (0.36, 0.38), (0.32, 0.40), which is generally within the yellow color range, see for example, FIG. 10. A "BSG LED" refers to a blue LED and an associated recipient luminophoric medium that together emit light having a color point that falls within a trapezoidal "BSG region" on the 1931 CIE Chromaticity Diagram defined by the following x, y chromaticity coordinates: (0.35, 0.48), (0.26, 0.50), (0.13, 0.26), (0.15, 0.20), (0.26, 0.28), (0.35, 0.48), which is generally within the green color range. A "BSR LED" refers to a blue LED that includes a recipient luminophoric medium that emits light having a dominant wavelength between 600 and 720 nm in response to the light emitted by the blue LED. A BSR LED will typically have two distinct spectral peaks on a plot of light output versus wavelength, namely a first peak at the peak wavelength of the blue LED in the blue color range and a second peak at the peak wavelength of the luminescent materials in the recipient luminophoric medium when excited by the light from the blue LED, which is within the red color range. Typically, the red LEDs and/or BSR LEDs will have a dominant wavelength between 600 and 660 nm, and in most cases between 600 and 640 nm.

More specifically, a "BSY LED" refers to a blue LED and an associated recipient luminophoric medium that together emit light having a color point that falls within a trapezoidal "BSY region" on the 1931 CIE Chromaticity Diagram of FIG. 8 defined by the following x, y chromaticity coordinates: (0.32, 0.40), (0.36, 0.48), (0.43, 0.45), (0.42, 0.42), (0.36, 0.38), (0.32, 0.40), which is generally within the yellow color range, see for example, FIG. 10. A "BSG LED" refers to a blue LED and an associated recipient luminophoric medium that together emit light having a color point that falls within a trapezoidal "BSG region" on the 1931 CIE Chromaticity Diagram defined by the following x, y chromaticity coordinates: (0.35, 0.48), (0.26, 0.50), (0.13, 0.26), (0.15, 0.20), (0.26, 0.28), (0.35, 0.48), which is generally within the green color range. A "BSR LED" refers to a blue LED that includes a recipient luminophoric medium that emits light having a dominant wavelength between 600 and 720 nm in response to the light emitted by the blue LED. A BSR LED will typically have two distinct spectral peaks on a plot of light output versus wavelength, namely a first peak at the peak wavelength of the blue LED in the blue color range and a second peak at the peak wavelength of the luminescent materials in the recipient luminophoric medium when excited by the light from the blue LED, which is within the red color range. Typically, the red LEDs and/or BSR LEDs will have a dominant wavelength between 600 and 660 nm, and in most cases between 600 and 640 nm.

Solid sate lighting structures used to generate light characterized using lumens and efficacy are further described in, for example, U.S. Provisional Patent Application No. 61/567,799, filed Dec. 7, 2011, entitled "OPTOELECTRONIC STRUCTURES WITH HIGH LUMENS PER WAFER," the disclosure of which is hereby incorporated herein by reference in its entirety.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

It will be understood that, as used herein, the term light emitting diode may include a light emitting diode, laser diode and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive layers.

In the drawings and specification, there have been disclosed example embodiments of the inventive subject matter and, although specific terms are employed, they are used in a generic and descriptive sense only and not for purposes of limitation, the scope of the inventive subject matter being set forth in the following claims.

What is claimed:

1. A solid state lighting apparatus comprising:

a Light Emitting Diode (LED) string including a plurality of light emitting diode (LED) segments coupled in series with one another wherein a ratio of respective lumen output from each of the segments, being provided by a respective total epi-area for each of the segments, is about equal to a ratio of respective average powers for each of the respective segments;

wherein a ratio of respective numbers of LEDs in each of the segments is about equal to the ratio of the respective average powers for each of the respective segments; and wherein a first-on/last-off segment included in the plurality of segments includes LEDs having highest efficacy of all LEDs in the string and a last-on/first-off segment included in the plurality of segments includes LEDs having lowest efficacy of all LEDs in the string.

2. The apparatus of claim 1 wherein the LEDs included in each of the segments are identical.

3. The apparatus of claim 1 wherein the respective number of LEDs in each of the segments are coupled together in parallel where the respective number is greater than 1.

4. The apparatus of claim 1 wherein the string includes 3 segments having equal forward voltages and a ratio of currents for respective utilizations of the segments of 1:2:3, wherein a ratio of respective efficacies of LEDs in each of the segments is 3 for a first-on/last-off segment, 2 for an intermediate segment, and 1 for a last-on/first-off segment.

5. The apparatus of claim 1 wherein the string includes 3 segments wherein the ratio of respective average powers in each of the segments is 17 for a first-on/last-off segment, 15 for an intermediate segment, and 9 for a last-on/first-off segment.

6. The apparatus of claim 1 wherein the ratio of respective numbers of LEDs in each of the segments comprises 3 in a first-on/last-off segment, 2 in an intermediate segment, and 1 for a last-on/first-off segment.

7. The apparatus of claim 1 further comprising:

a rectifier circuit housed in the solid state lighting apparatus, coupled to an ac voltage source configured to provide a rectified ac voltage; and a driver circuit, coupled to the rectifier circuit and configured to provide current to the string.

8. The apparatus of claim 1 wherein the driver circuit further comprises:

a plurality of current diversion circuits, respective ones of which are coupled in parallel with respective segments and configured to operate responsive to bias state transitions of the respective segments.

9. A solid state lighting apparatus comprising:

a Light Emitting Diode (LED) string including a plurality of light emitting diode (LED) segments coupled in series with one another, wherein a first-on/last-off segment included in the plurality of segments includes LEDs having highest efficacy of all LEDs in the string and a last-on/first-off segment included in the plurality of segments includes LEDs having lowest efficacy of all LEDs in the string.

10. The apparatus of claim 9 wherein a ratio of respective numbers of LEDs in each of the segments is about equal to a ratio of respective average powers for each of the respective segments.

11. The apparatus of claim 9 wherein a respective number of LEDs in each of the segments are coupled together in parallel where the respective number is greater than 1.

12. The apparatus of claim 9 wherein the string includes 3 segments wherein a ratio of respective efficacies of LEDs in each of the segments is 3 for the first-on/last-off segment, 2 for an intermediate segment, and 1 for the last-on/first-off segment.

13. The apparatus of claim 9 wherein the string includes 3 segments and a ratio of respective average powers in each of the segments is 17 for a first-on/last-off segment, 15 for an intermediate segment, and 9 for a last-on/first-off segment.

14. The apparatus of claim 9 wherein the string includes 3 segments and a ratio of respective numbers of LEDs in each of the segments comprises 3 in the first-on/last-off segment, 2 in an intermediate segment, and 1 for the last-on/first-off segment.

15. The apparatus of claim 9 further comprising:

a rectifier circuit housed in the solid state lighting apparatus, coupled to an ac voltage source configured to provide a rectified ac voltage; and a driver circuit, coupled to the rectifier circuit and configured to provide current to the string.

16. The apparatus of claim 15 wherein the driver circuit further comprises:

a plurality of current diversion circuits, respective ones of which are coupled in parallel with respective segments and configured to operate responsive to bias state transitions of the respective segments.

17. A solid state lighting apparatus comprising:

a Light Emitting Diode (LED) string including a plurality of light emitting diode (LED) segments coupled in series with one another, wherein a ratio of respective numbers of LEDs in each of the segments is about equal to a ratio of respective average powers for each of the respective segments and a first-on/last-off segment included in the plurality of segments includes highest efficacy LEDs in the string and a last-on/first-off segment included in the plurality of segments includes lowest efficacy LEDs in the string.

18. The apparatus of claim 17 wherein the string includes 3 segments each having equal forward bias voltages, a ratio of respective efficacies of LEDs in the segments is: 3 for the first-on/last-off segment, 2 for an intermediate segment, and 1 for the last-on/first-off segment.

19. The apparatus of claim 17 wherein the string includes 3 segments and a ratio of respective average powers in each of the segments is 17 for the first-on/last-off segment, 15 for an intermediate segment, and 9 for the last-on/first-off segment.

20. The apparatus of claim 17 wherein the string includes 3 segments and a ratio of respective numbers of LEDs in each of the segments comprises 3 in the first-on/last-off segment, 2 in an intermediate segment, and 1 for the last-on/first-off segment.

21. The apparatus of claim 17 further comprising:

a rectifier circuit housed in the solid state lighting apparatus, coupled to an ac voltage source configured to provide a rectified ac voltage; and a driver circuit, coupled to the rectifier circuit and configured to provide current to the string.

22. The apparatus of claim 21 wherein the driver circuit further comprises:

a plurality of current diversion circuits, respective ones of which are coupled in parallel with respective segments and configured to operate responsive to bias state transitions of the respective segments.

* * * * *

UNITED STATES PATENT AND TRADEMARK OFFICE

CERTIFICATE OF CORRECTION

PATENT NO. : 9,179,512 B2
APPLICATION NO. : 13/672315
DATED : November 3, 2015
INVENTOR(S) : Ni It is certified that error appears in the above-identified patent and that said Letters Patent is hereby corrected as shown below:

In the Specification:

Column 7, Line 65: Please correct "(11:12:13)" to read -- (I1:I2:I3) --

Signed and Sealed this
Third Day of May, 2016

Michelle K. Lee

Michelle K. Lee
*Director of the United States Patent and Trademark Office*